US006848768B2

(12) United States Patent
Roberts

(10) Patent No.: US 6,848,768 B2
(45) Date of Patent: Feb. 1, 2005

(54) COLOR INK MODEL PROCESSES FOR PRINTERS

(75) Inventor: Peter Malcolm Roberts, Birchgrove (AU)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 10/112,937

(22) Filed: Apr. 2, 2002

(65) Prior Publication Data

US 2003/0065491 A1 Apr. 3, 2003

Related U.S. Application Data

(63) Continuation of application No. 09/708,625, filed on Nov. 9, 2000, now abandoned.

(30) Foreign Application Priority Data

Nov. 12, 1999 (AU) ..... PQ4035
Nov. 12, 1999 (AU) ..... PQ4036

(51) Int. Cl.[7] ..... B41J 2/21; B41J 2/205
(52) U.S. Cl. ..... 347/43; 347/15
(58) Field of Search ..... 347/43, 15, 19, 347/14; 358/1.9, 502

(56) References Cited

U.S. PATENT DOCUMENTS

| | | | | |
|---|---|---|---|---|
| 4,649,502 A | | 3/1987 | Keller et al. | 364/519 |
| 4,803,496 A | | 2/1989 | Kawakami et al. | 346/76 PH |
| 5,530,656 A | | 6/1996 | Six | 364/526 |
| 5,563,724 A | * | 10/1996 | Boll et al. | 358/502 |
| 5,832,109 A | * | 11/1998 | Mahy | 382/162 |
| 6,320,676 B1 | * | 11/2001 | Yoshidome | 358/1.9 |

* cited by examiner

*Primary Examiner*—Thinh Nguyen
(74) *Attorney, Agent, or Firm*—Fitzpatrick, Cella, Harper & Scinto

(57) ABSTRACT

A method of predicting colors resulting from using one ink on a printer. The method includes the steps of:

producing a test page for the printer, the test page having a plurality of sample ink patches, each patch having a plurality of ink dots according to a predetermined ratio for each patch, the predetermined ratios being based on a number of dots printed for a corresponding patch compared to a maximum number of dots;

measuring each of the sample ink patches to produce a plurality of color space coordinates for each patch; and fitting values representing a number of dots for each patch and color space coordinates to a plurality of predetermined functions using a minimization process in order to predict the colors.

49 Claims, 5 Drawing Sheets

COLOR INK MODEL PROCESSES FOR PRINTERS

CROSS REFERENCE TO RELATED APPLICATION

This is a continuation of parent application Ser. No. 09/708,625, filed Nov. 9, 2000, now abandoned.

FIELD OF INVENTION

The present invention relates to colour ink model processing including a method and apparatus for printer characterisation and, in particular, for characterising colour printers, and inversion of the colour ink model. The invention also relates to a computer program product including a computer readable medium having recorded thereon a computer program for printer such processing.

BACKGROUND

Colour printer characterisation is the process of determining the colour a printer will produce when a certain amount of ink of the various available colours is requested by a given printer. In order to carry out colour printer characterisation, a relationship between signals input to the printer and colorimetric values for printed colours must be established. The relationship is generally expressed as a printer characterisation function. One known method of determining the printer characterisation function for a given printer is by firstly, producing a test page with a predetermined number of sample colour patches, secondly, measuring the colour of each colour patch and finally, interpolating among the measurements. However, this method is time consuming and is not very accurate.

Another known method of determining the printer characterisation function is to determine a printer model, which approximates the function. The main advantage of modelling is that the printer characterisation can be carried out with a comparatively small number of measurements resulting in a large time saving. In determining the printer model, some assumptions are necessary in order to simplify the mathematics involved. The accuracy of the printer model will be limited by these assumptions.

One known printer model is the Neugebauer mixing model. The Neugebauer model is used in modelling and characterising colour printers. The Neugebauer model is used to predict the colour of a print on a given printer, as a weighted average of the XYZ values of the solid overprints of the three primaries (ie. cyan (C), magenta (M) and yellow (Y)). The weights of each colour are determined by the relative dot area coverages of C, M and Y constituting the print. The dot area coverages for the digital input values are determined using a combination of direct measurement and calculation.

As discussed above, the Neugebauer model provides the characterisation function from device values (C,M,Y) to colorimetric values (XYZ). However, for printer characterisation the inverse mapping (ie., from colorimetric values to device values) is required.

Numerical methods are used to invert a printer characterisation function, which is non-linear. However, a problem occurs when a printer characterisation function has more than three inks, as a number of different ink combinations can result in the same colour.

Several methods have been proposed for optimising the Neugebauer model. One such method is discussed in an article by Balasubramanian et al, entitled "Optimisation of the spectral Neugebauer model for printer characterisation", Journal of Electronic Imaging, April 1999, Vol. 8(2). The method uses weighted spectral regression for optimising the Neugebauer primaries in order to characterise Xerographic printers. However, the method proposed by Balasubramanian et al does not work on ink-jet printers where inaccuracies are found in the optimised Neugebauer model proposed in the article.

It is an object of the present invention to ameliorate one or more of the limitations of the methods described above.

SUMMARY OF THE INVENTION

In accordance with one aspect of the present disclosure, there is provided a method of predicting colours resulting from using one ink on an ink jet printer, said method comprising the steps of:

producing a test page for said printer, said test page comprising a plurality of sample ink patches, each said patch comprising a plurality of ink dots with each ink dot being of a predetermined quantity of ink;

measuring each of said sample ink patches to produce a plurality of colour space coordinates for each said patch; and fitting values representing a total quantity of ink for each said patch and said colour space coordinates to a plurality of predetermined functions using a minimisation process, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents said predetermined quantity of ink, $f_x(a)$, $f_y(a)$ and $f_z(a)$ are functions of a, and wherein $P_x$, $P_y$ and $P_z$ are colour space components representing a paper colour, and $I_x$, $I_y$ and $I_z$ are colour space components representing the ink colour.

In accordance with another aspect of the present disclosure, there is provided a method of predicting colours resulting from using one ink on a printer, said method comprising the steps of:

producing a test page for said printer, said test page comprising a plurality of sample ink patches, each said patch comprising a plurality of ink dots with each ink dot being of a predetermined quantity of ink;

measuring each of said sample ink patches to produce a plurality of colour space coordinates for each said patch; and fitting values representing a total quantity of ink for each said patch and said colour space coordinates to a plurality of predetermined functions using a minimisation process, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents said predetermined quantity of ink, $f_x(a)$, $f_y(a)$ and $f_z(a)$ are functions of a and are derived from a section of the curve y=1/x, and wherein $P_x$, $P_y$ and $P_z$ are colour space components representing a paper colour, and $I_x$, $I_y$ and $I_z$ are colour space components representing the ink colour.

In accordance with another aspect of the present disclosure, there is provided a method of predicting colours resulting from using one ink on a printer, said method comprising the steps of:

producing a test page for said printer, said test page comprising a plurality of sample ink patches, each said patch comprising a plurality of ink dots with each ink dot being of a predetermined quantity of ink;

measuring each of said sample ink patches to produce a plurality of colour space coordinates for each said patch; and fitting values representing a total quantity of ink for each said patch and said colour space coordinates to a plurality of predetermined functions using a minimisation process, wherein said predetermined functions are of the form:

$$C = \sum_{p=K} C_p \left[ \prod_{i=0}^{n} I_i \in p ? f(a_i) : 1 - f_i(a_i) \right] \left[ \prod_{i=0}^{n} H_i \in p ? g(a_i) : 1 - g_i(a_i) \right]$$

wherein C represents a resultant component of said colour space, and wherein

K is a Double Neugebauer Set of colour elements $=\{P_1, \ldots, P_2^{2n}\}$;

$C_p$ is the X, Y or Z component of the XYZ colour of the primary p;

$I_i \epsilon p$ is true if the $i^{th}$ ink's primary colour is included in the Neugebauer primary p;

$H_i \epsilon p$ is true if the $i^{th}$ ink's secondary color is included in the Neugebauer primary p;

$$f_i(a_i) = \frac{a_i}{a_i(1-k_i)+k_i};$$

$$g(a_i) = k'_i a_i; \text{ and}$$

wherein said expression P?x:y takes the value x if P is true and y otherwise, and $k_i$ and $k'_i$ are constants derived for said printer.

In accordance with another aspect of the present disclosure, there is provided a method of determining a first approximation for the iterative computation of amounts of ink which will result in a required colour when printed on a printer, where said required colour can be determined by the use of an analytical printer characterisation function, said method operating in a Cartesian colour coordinate colour space and comprising the step of:

(a) determining the colour of black on the printer;

(b) if the required colour is close to black, said first approximation comprises those inks required to produce black;

(c) if the required colour is not black:

(i) construct a line that passses through black and said required colour (ii) determine the intersection of said line and each plane defined by sets of three colours (c1, c2, c3), each said set creating a corresponding triangle resulting from the following ink combinations:

| Ink1 | Ink2 | Ink3 |
|---|---|---|
| Paper | Yellow | Cyan |
| Paper | Cyan | Magenta |
| Paper | Magenta | Yellow |
| Yellow + Cyan | Yellow | Cyan |
| Cyan + Magenta | Cyan | Magenta |
| Magenta + Yellow | Magenta | Yellow |

(iii) if the intersection of the line and the plane lies within the triangle:

then (iii-a) compute weights (w1, w2, w3) which have to satisfy w1c1+w2c2+w3c3=colour at the intersection; and (iii-b) compute said first approximation for the amounts of ink as w1*Ink1+w2*Ink2+w3Ink3;

or else (iii-c) use paper colour (no ink).

BRIEF DESCRIPTION OF THE DRAWINGS

A number of preferred embodiments of the present invention will now be described with reference to the drawings, in which.

DETAILED DESCRIPTION INCLUDING BEST MODE

Figure 1:
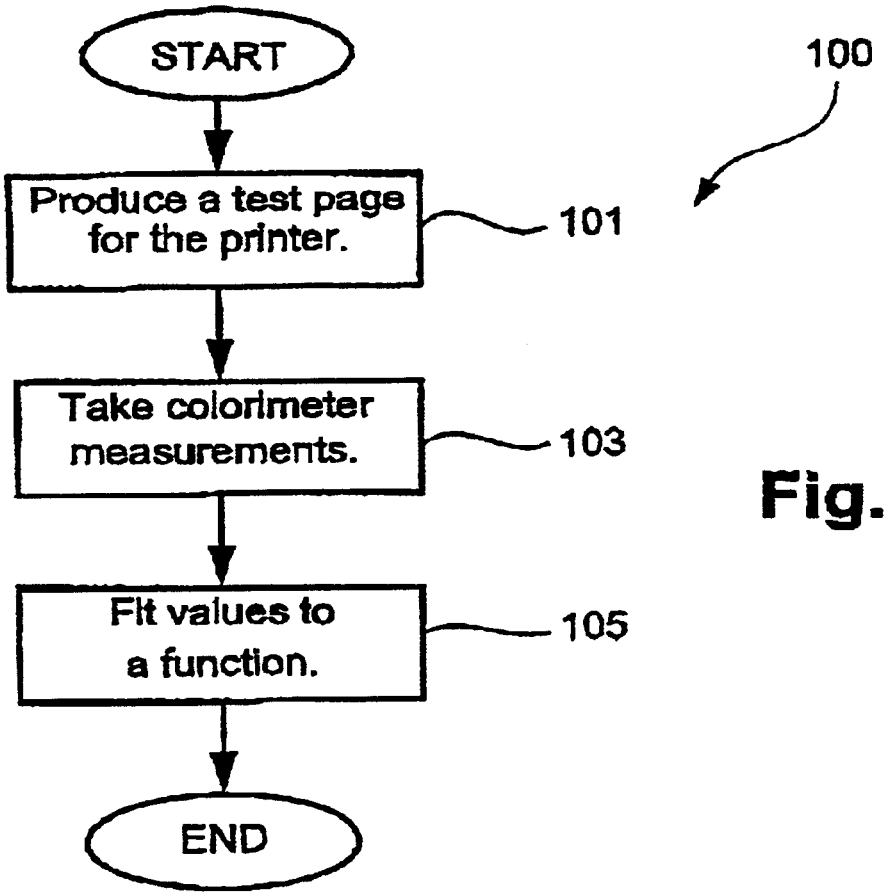
FIG. 1 is a flowchart showing a method of characterising a colour printer.

Where reference is made in any one or more of the accompanying drawings to steps and/or features, which have the same reference numerals, those steps and/or features have for the purposes of this description the same function (s) or operation(s), unless the contrary intention appears.

FIG. 1 is a flowchart showing a method 100 of characterising a colour printer having particular application to ink-jet printers. However, the method can be used to characterise any printing device that performs colour gradation by placing a plurality of dots of the same size on a page. The process begins at step 101, where a test page (or Measurement Set) is produced for a given printer to be characterised. The test page includes a number of sample colour patches. To ensure accuracy, a sufficiently large number of sample colour patches covering the full colour gamut of the printer, is required. The ink amounts for each colorant (eg. CMYK) contributing to each sample colour patch is also required to be known. At the next step 103, a colorimeter is used to take measurements of the sample colour patches, in a colour space which is linear in power of light. The CIE (1931) XYZ colour space is preferably used. However, any linear colour space can be utilised. The result of the colorimeter measurements is a set of XYZ values for each sample colour patch on the test page. The process continues at step 105, where the ink amounts for each colorant of each colour sample patch and the corresponding measured XYZ values are fitted to a function, using a minimisation process such as the least squares process.

The printer characterisation function thus formed is a multi-linear interpolation of an extended set of Neugebauer primaries with an adjustment. The function is derived from the assumption that each dot printed on a page by a printer has a small halo of slightly different colour. The function will be explained in more detail later in this document. The computation must be repeated independently for X, Y and Z. The result of each independent computation is a set of values for each of the extended set of Neugebauer primaries and values for two constants $k_i$ and $k'_i$ for each ink. The computation will be explained in more detail later in this document.

The method 100 of characterising a printer will work on a printer with any number of inks. For example, the preferred method will give device values for a CMY printer, a CMYK printer or a six-ink (i.e., $C^+C^-M^+M^-YK$) printer.

The printer characterisation function of the method 100 may be conveniently appreciated by letting S represent the set of all inks of a printer. The usual definition of the set of Neugebauer primaries is the set of colours of all combinations of the elements of the set S. The combination which is the empty set is also included and represents the paper colour. The method 100 uses an augmented set which the inventor has referred to as a "Double Neugebauer set" and is based on a set S which contains not only the inks of the printer, but also the halos of the inks of the printer. The basis set S for the Double Neugebauer set is that such a set contains twice the number of elements (as found in the basis set for a standard Neugebauer set) and therefore the number of elements in the Double Neugebauer Set is the square of the number in the usual Neugebauer set.

Ink jet printers must use a halftoning method to determine which dots to turn on. In the method 100, the proportion of dots which are turned on is represented as $(a_1, \ldots, a_n)$ where n is the number of inks on the printer.

The X component of the XYZ colour of a patch printed on an ink jet printer with n inks which have been printed with levels $(a_1, \ldots, a_n)$ for each of the inks is given by inserting the computed values for X for each of the Double Neugebauer primaries, and the values for the constants $k_i$ and $k'_i$ into the following printer characterisation function (ie: "Multi-Ink Model):

$$C = \sum_{p \in K} C_p \left[ \prod_{i=0}^{n} I_i \in p ? f_i(a_i) : 1 - f(a_i) \right] \left[ \prod_{i=0}^{n} H_i \in p ? g_i(a_i) : 1 - g(a_i) \right] \quad (1)$$

where:

K is the Double Neugebauer set of colours $=\{P_1, \ldots, P_{2^{2n}}\}$;

$C_p$ is the X, Y or Z component of the XYZ colour of the primary p;

$I_i \in p$ is true if the $i^{th}$ ink is included in the Neugebauer primary p;

$H_i \in p$ is true if the $i^{th}$ ink's halo is included in the Neugebauer primary p; and $$f_i(a_i) = \frac{a_i}{a_i(1-k_i)+k_i}; \quad (2)$$

$$g_i(a_i) = k'_i a_i; \text{ and}$$

the expression q?a:b takes the value a if q is true and b if q is false.

Similarly, the Y and Z components can be computed and will give rise to different values for $k_i$ and $k_i'$.

The method 100 of characterising a printer will now be explained in further detail including the manner in which the Double Neugebauer Set is derived.

When an ink is printed on a page as dots which have consistent colour, the resultant perceived colour can be expressed as (X,Y,Z), where;

$$X = x\int X(\lambda)I(\lambda)d\lambda + (1-x)\int X(\lambda)P(\lambda)d\lambda,$$

$$Y = x\int Y(\lambda)I(\lambda)d\lambda + (1-x)\int Y(\lambda)P(\lambda)d\lambda,$$

$$Z = x\int Z(\lambda)I(\lambda)d\lambda + (1-x)\int Z(\lambda)P(\lambda)d\lambda, \quad (3)$$

and where, x is the proportion of paper that is covered with ink;

X(λ), Y(λ) and Z(λ) are the CIE 1931 Standard Observer sensitivity functions;

I(λ) is the ink reflectance spectrum for the given illuminant;

P(λ) is the paper's reflectance spectrum for the given illuminant; and

X, Y and Z are the resultants components of the colour in the CIE 1931 XYZ colour representation.

Notably, $\int X(\lambda)P(\lambda)d\lambda$, $\int Y(\lambda)P(\lambda)d\lambda$, and $\int Z(\lambda)P(\lambda)d\lambda$ are all measurable as the colour of the paper for the given illuminant. This can be expressed as $$P = (X_p, Y_p, Z_p) \quad (4)$$

Similarly to the single ink case discussed above, for a CMYK printer the CIE XYZ values can be measured for each colourant and expressed as follows:

$$C = (X_c, Y_c, Z_c);$$

$$M = (X_m, Y_m, Z_m);$$

$$Y = (X_y, Y_y, Z_y); \text{ and}$$

$$K = (X_k, Y_k, Z_k).$$

C, M, Y and K represent the colours of each ink on a given paper type for a given illuminant.

Similarly, the colours of ink combinations can be defined. For example, let CM represent the colour of the paper covered by both Cyan and Magenta ink.

For two inks (eg., cyan and magenta), the colour of the two inks printed as two layers on a given paper type, for a given illuminant, can be expressed as follows:

$$(1-c)(1-m)P + (1-c)m\ M + c(1-m)C + cm\ CM \quad (5)$$

where:

c is the proportion of the page covered by cyan ink; and m is the proportion of the page covered by magenta ink.

The above expression (5) assumes that the ink dots are randomly positioned over the page. For more inks the expression (5) can be extended.

Figure 2:
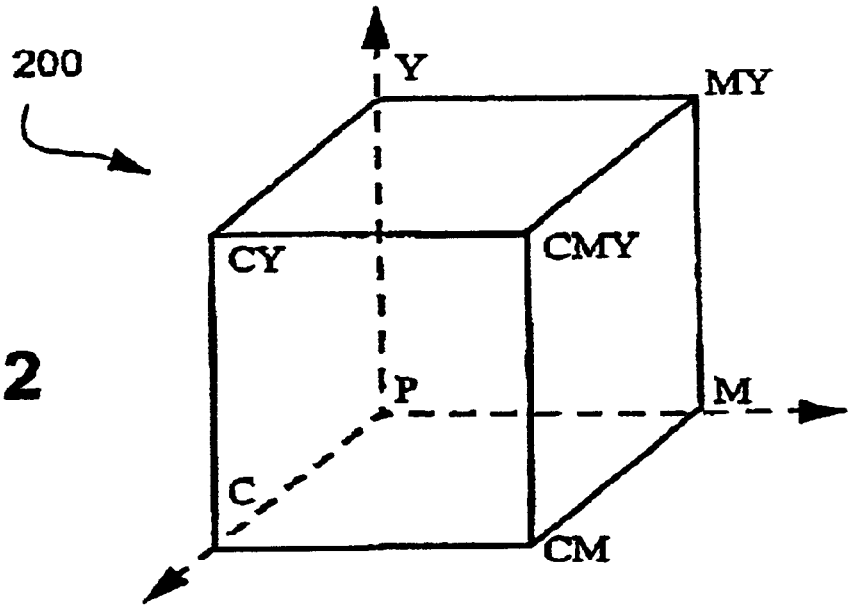
FIG. 2 shows a cube representing the Neugebauer mixing model for a three ink printer.

FIG. 2 shows a cube 200 representing the Neugebauer primaries for three inks cyan, magenta and yellow. Expression (5) can be extended to correspond to a tri-linear interpolation in the cube 200, as shown in FIG. 2, where the colours measured are in the corners.

Figure 3A:
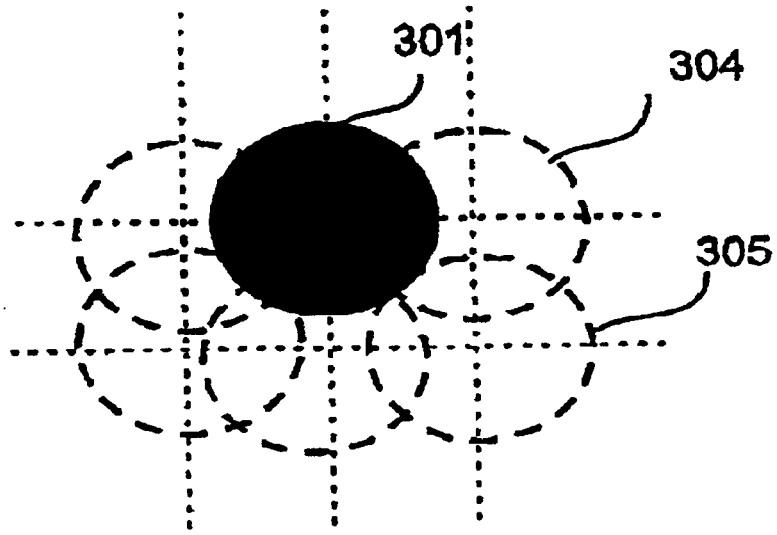
FIG. 3A shows the area of one dot printed on paper.
Figure 3B:
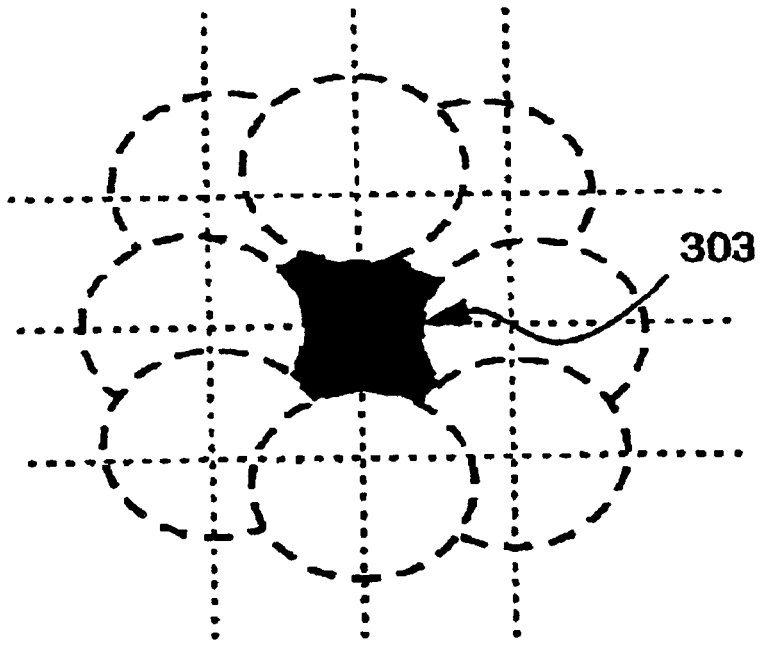
FIG. 3B shows the area of a subsequent dot printed on paper.

To predict the colour of a patch of a single ink a non-linear function of the proportion of dots printed must be used. For an ink-jet printer the inventor has observed that the placing of ink on a given paper has some specific characteristics. Firstly, because the dots of ink are all of the same size, dot gain is largely irrelevant to the model once the effective dot size is determined. Secondly, the dots are placed in a grid pattern. FIG. 3A shows a representation of the area covered by one dot 301 printed on paper. The dots in broken lines (eg. 304, 305) represent the area covered by subsequent dots printed on the paper. Therefore, the first dot printed covers a full dot area 301 of the paper, whereas the final dot printed only adds the area 303 between existing dots, as seen in FIG. 3B.

Letting d represent the area of a single dot, n represent the number of bits of colour resolution of a half toning algorithm, D represent the grid area of a single dot and f(x) represent the ratio of ink coverage for the domain x=0–1, such that f(0)=0 and f(1)=1, then:

$$f\left(\frac{1}{2^n-1}\right)=\frac{d}{D(2^n-1)}. \tag{6}$$

Therefore $$\begin{aligned} f'(0) &\approx \frac{d}{D(2^n-1)}\Big/\frac{1}{2^n-1} \\ &= \frac{d}{D} \\ &= 1+\frac{d-D}{D}; \text{ and} \end{aligned} \tag{7}$$

for a printer with ideal dot size, $$f\left(\frac{2^n-2}{2^n-1}\right)=1-\frac{D-(d-D)}{D(2^n-1)}; \tag{8}$$

Therefore $$\begin{aligned} f'(1) &\approx \frac{D-(d-D)}{D(2^n-1)}\Big/\frac{1}{2^n-1} \\ &= 1-\frac{d-D}{D} \end{aligned} \tag{9}$$

Now, letting $$\delta=\frac{d-D}{D},$$

then f'(0)=1+δ and f'(1)=1−δ.

If δ is small, as it should be for a good printer, then $$1+\delta\cong\frac{1}{1-\delta}.$$

Therefore, $$f'(0)\cong\frac{1}{f'(1)}.$$

Figure 4:
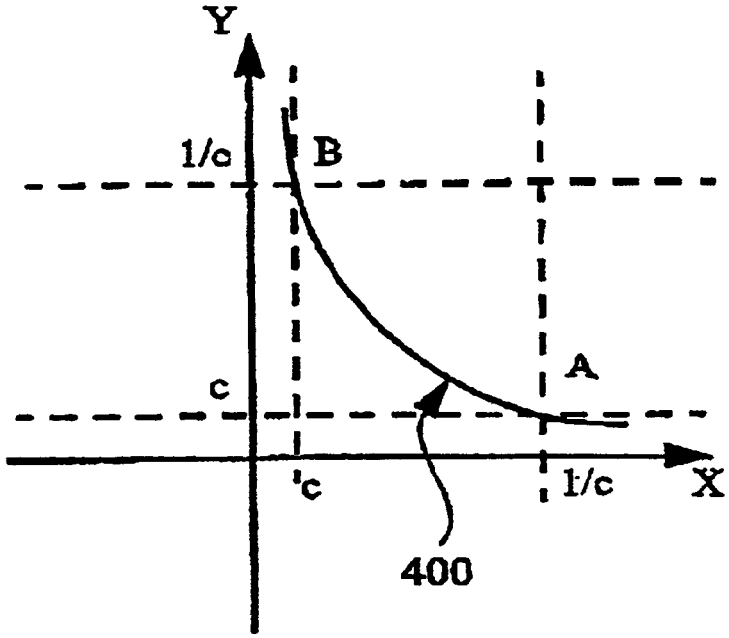
FIG. 4 shows the function Y=1/X.

In view of the foregoing, and the fact that a symmetrical section of the function y=1/x shows the same characteristic, as shown in FIG. 4 (and indicated as 400), the inventor has found that the function y=1/x closely fits the characteristics of a single ink blend displayed by an ink-jet printer placing ink on paper. With reference to FIG. 4, the curve from B to A can be re-scaled to have a range and domain of 0–1. Therefore, $$\begin{aligned} f(x) &= \frac{1}{\frac{1}{c}-c}\left[\frac{1}{x\left(\frac{1}{c}-c\right)+c}-c\right] \\ &= \frac{c}{1-c^2}\left[\frac{c}{x(1-c^2)+c^2}-c\right] \\ &= \frac{c^2}{1-c^2}\left[\frac{1}{x(1-c^2)+c^2}-1\right] \end{aligned} \tag{10}$$

Substituting k for $c^2$ and inverting the function in the range 0–1, $$\begin{aligned} f(x) &= 1-\frac{k}{1-k}\left[\frac{1}{x(1-k)+k}-1\right] \\ &= 1-\frac{k}{1-k}\left[\frac{1-k-x(1-k)}{x(1-k)+k}\right] \\ &= 1-k\left[\frac{1-x}{x(1-k)+k}\right] \\ &= -\left[\frac{k(1-x)-x(1-k)-k}{x(1-k)+k}\right] \\ &= \left[\frac{x}{x(1-k)+k}\right] \end{aligned} \tag{11}$$

$$C_X=(1-f(x))P_X+f(x)I_X \tag{12}$$

The function (11) was substituted in Equation (12) and the result was fitted to the data for single ink blends using a least squares fit process. The present inventor found that the function yielded a good fit, especially to colorimetric data for a cyan blend. However, systematic error was found, particularly in the black end of a black ink blend.

Figure 5:
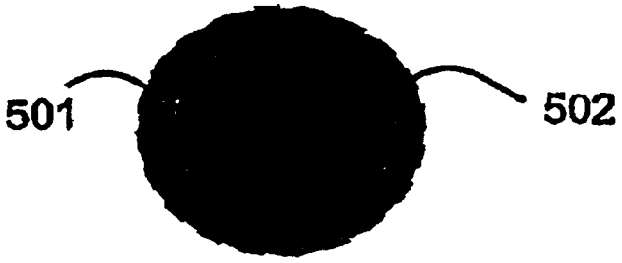
FIG. 5 shows a dot with a single halo printed on paper.

The inventor observed that ink dots have uneven colour, possibly caused by chromatography. The chromotography was assumed to be responsible for the systematic error. To allow for the chromatography effect the inventor based the preferred printer characterisation function on a dot 501 with a single halo 502 of different colour, as shown in FIG. 5. The inventor also assumed, to simplify the mathematics of the model, that the positions of the dot 501 and the single halo 502 were completely independent. The halo 502 was also allowed to be different in size and intensity for each of the X, Y and Z channels. Therefore, the X component of the colour, $C_X$, of a single ink blend printed on a page can be expressed as follows:

$$C_X=(1-f(x))(1-g(x))P_X+f(x)(1-g(x))I_X+(1-f(x))g(x)H_X+f(x)g(x)HI_X \tag{13}$$

where:

$H_X$ is the X component of the halo colour; and $HI_X$ is the X component of the overlap of halo and ink.

The halo size can be assumed to be substantially smaller than the ideal dot size, in which case the function g(x) will be of the form:

$$g(x)=k'x \tag{14}$$

where k' is not the same as k.

When fitting the resulting equation (13) to the blend data, it is not possible to determine values for all of the colours $H_X$, $I_X$ and $HI_X$ since they are not orthogonal in the observation equation set. Therefore, two new constraints are added:

$$H_X=I_X$$

$$H_{IX}=I_X \tag{15}$$

without loss of generality. The equation (13) can be further simplified to $$C_X=(1-f(x))(1-k'x)P_X+(f(x)+(1-f(x))k'x)I_X \tag{16}$$

The above formula (16) for $C_X$ represents a "Single-Ink Halo Model" and was found by the present inventor to show no observable systematic error when blend data was fitted to it.

A least squares approach was taken to deriving the parameters for the simple single-ink model (Equation (12)) using the measured observations for X, Y and Z. The single-ink model is not linear in k and so it is necessary to derive the parameters iteratively as explained below:

Letting:

$P_X$ represent the X component of the paper colour;

$I_X$ represent the X component colour of the ink dot on the paper;

$$k_{n+1}=k_n+\delta k \tag{17}$$

$$P_{Xn+1}=P_{Xn}+\delta P_X \tag{18}$$

$$I_{Xn+1}=I_{Xn}+\delta I_X \tag{19}$$

If $k_0$, $P_{X0}$ and $I_{X0}$ represent first approximations to the values of k, $P_X$ and $I_X$, then Equations (17) to (18) represent successive refinements to these approximations, provided the three δ terms can be solved for.

The observation equations are of the form:

$$X = P_X\left(1-\frac{x}{x(1-k)+k}\right)+I_X\left(\frac{x}{x(1-k)+k}\right) \tag{20}$$

and substituting equations (17) to (19) in Equation (20) results in the following:

$$X = (P_{Xn}+\delta P_X)\left(1-\frac{x}{x(1-k_n-\delta k)+k_n+\delta k}\right)+ (I_{Xn}+\delta I_X)\left(\frac{x}{x(1-k_n-\delta k)+k_n+\delta k}\right) \tag{21}$$

Ignoring second order terms, Equation (21) can be reduced to:

$$X = P_{Xn}\left(1-\frac{x}{x(1-k_n)+k_n}\right)+I_{Xn}\frac{x}{x(1-k_n)+k_n}+ \delta P_X\left[1-\frac{x}{x(1-k_n)+k_n}\right]+ \tag{22}$$

-continued $$\delta I_X\left[\frac{x}{x(1-k_n)+k_n}\right]+ \delta k\left[(P_{Xn}-I_{Xn})\frac{x(1-x)}{(x(1-k_n)+k_n)^2}\right]$$

Equation (22) is now a set of observation equations that can be solved for the δ terms using least squares. The n+1 values are substituted for the n values, and solved iteratively until the δ terms become sufficiently small.

The same technique of iterative least squares can be employed to solve the Halo model (ie. Equation (16)) and the observation equations for the Halo Model are:

$$X = P_{Xn}\left(1-\frac{x}{x(1-k_n)+k_n}\right)(1-(k_n'+\delta k')x)+ I_X\left[\frac{x}{x(1-k)+k}(1-k'x)+k'x\right]+ \delta P_X\left[\left(1-\frac{x}{x(1-k_n)+k_n}\right)(1-k_n'x)\right]+ \delta I_X\left[\frac{x}{x(1-k_n)+k_n}(1-k_n'x)+k_n'x\right]+ \delta k\left[(P_{Xn}-I_{Xn})\frac{x(1-x)}{(x(1-k_n)+k_n)^2}\right]+ \delta k'\left[(I_{Xn}-P_{Xn})x\left(1-\frac{x}{x(1-k_n)+k_n}\right)\right] \tag{23}$$

Multi-ink characterisation can be modelled by an extension of the above Equation (16). As discussed above, the single ink model assumes a mix of two "inks" being the ink itself and the ink's halo. For the multi-ink case, the Double Neugebauer set of primaries is used.

By letting S be the set of all inks, then the usual Neugebauer set is the set of colours of all combinations of the elements of set S. The set which is similarly defined but is based on a set S which contains not only the inks but the halos of these inks as well. The basis set S for this set contains double the number of elements. Therefore, the number of elements in this set is actually the square of the number in the usual Neugebauer set and can thus be referred to as the "Double Neugebauer Set".

The colour of a patch of n inks with levels $(a_1, \ldots, a_n)$ for each of the inks is then predicted using the "Multi-ink Model" as follows:

$$C=\sum_{p\in K} C_p\left[\prod_{i=0}^{n} I_i \in p\,?\,f_i(a_i):1-f_i(a_i)\right] \left[\prod_{i=0}^{n} H_i \in p\,?\,g_i(a_i):1-g_i(a_i)\right] \tag{24}$$

where:

K is the Double Neugebauer set of colours $=\{P_1, \ldots, P_{2^{2n}}\}$;

$C_p$ is the X, Y or Z component of the XYZ colour of the primary p;

$I_i \epsilon p$ is true if the $i^{th}$ ink is included in the Neugebauer primary p;

$H_i \epsilon p$ is true if the $i^{th}$ ink's halo is included in the Neugebauer primary p; and $$f_i(a_i) = \frac{a_i}{a_i(1-k_i)+k_i};$$

$$g_i(a_i) = k'_i a_i; \text{ and}$$

the expression P?a:b takes the value a if p is true and b if p is false.

Similarly, the Y and Z components can be computed.

The multi-ink model (ie. Equation (24)) cannot be solved for $k_i$, $k'_i$ and $Cp_X$ using a minimising method, such as least squares fit, since the least squares matrix is singular. The singularity occurs since there is insufficient information to determine the constants $k_i$ and $k'_i$, and the Halo components of the set K. As at Equation (13), the Halo components cannot be computed and can be set to the colour without the Halo without loss of generality. In addition, some of the multiple Halo components do not contribute significantly to the overall result and can therefore be assumed to be either redundant or the same as other components. Assuming some of the Halo components to be the same as other components significantly reduces the amount of measurement and computation necessary to solve the multi-ink model.

Figure 6:
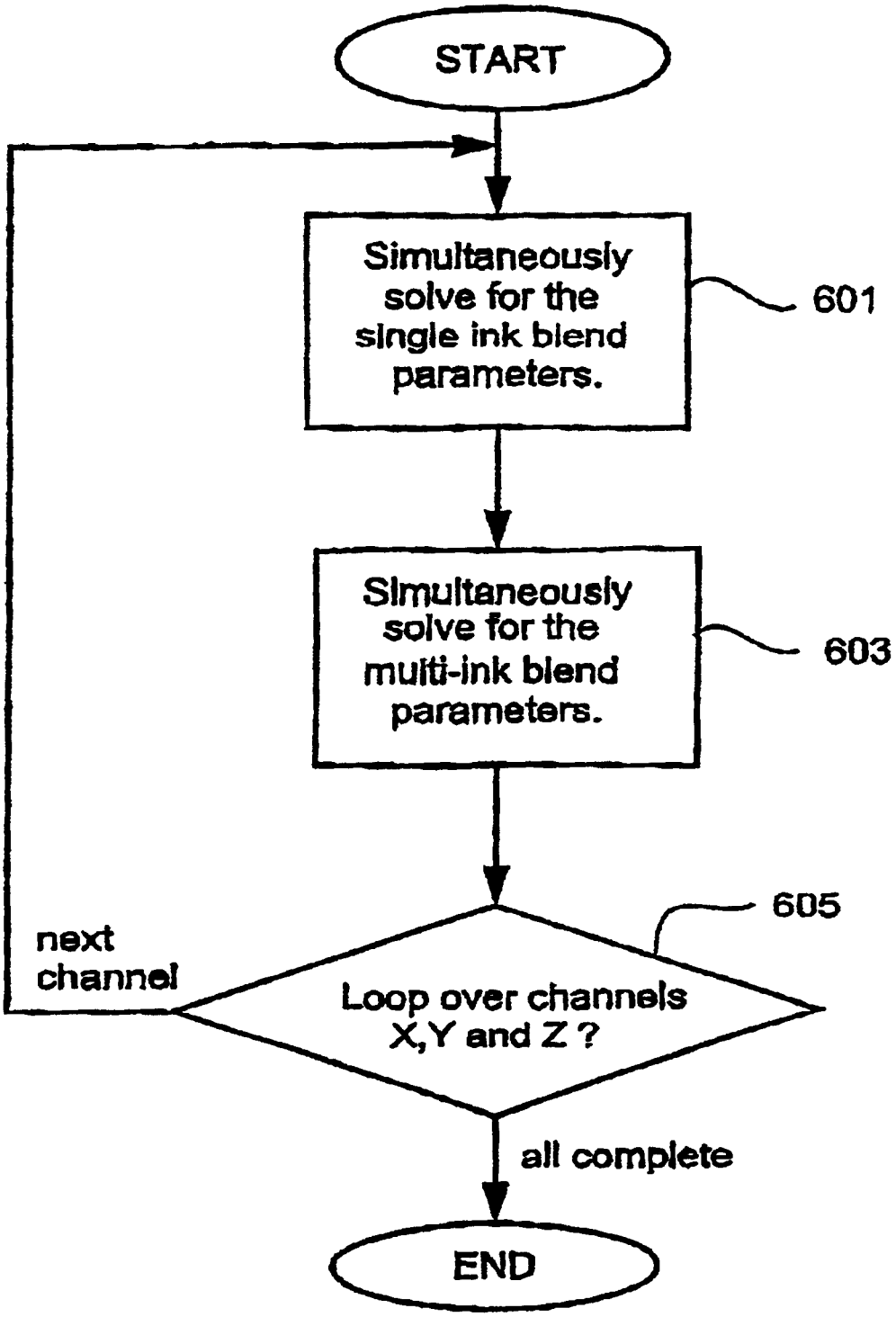
FIG. 6 shows the method of solving the multi-ink model in accordance with the preferred embodiment of the present invention.

Equation (24) can be solved in two steps, as seen in the flow chart of FIG. 6. The process begins at step 601, where the Equation (24) is used to simultaneously solve for the single-ink blend parameters $k_i$, $k'_i$, the paper colour and $I_i$, after inserting the measured observation values for X, Y and Z for each of the Neugebauer primaries into Equation (16). The solution is non-linear in $k_i$ and so must be carried out iteratively. However, it is not possible to solve for $H_x$ and $HI_x$ since it is not possible to know all of the elements in the Double Neugebauer set. At the next step 603, the remaining multi-ink blend parameters are simultaneously directly solved for, using an independent procedure, by removing any redundant elements of the Double Neugebauer set. The process concludes at step 605, when steps 601 and 603 have been repeated for each of the X, Y and Z components.

As discussed above, the inventor found that using the method of FIG. 6 to solve the multi-ink model resulted in the $k'_i$ and many of the Double Neugebauer set having little physical meaning due to the arbitrary constraints which are imposed at Equation (15). In a preferred implementation, step 603 of FIG. 6 requires specific rules in order to decide which of the Neugebauer primaries are redundant and can be eliminated from the computation of the multi-ink parameters. Those rules are as follows:

(i) The values that are already known from the single ink blend computation do not need to be calculated again. These known values are the paper colour, single ink colours, single halo colours and the combinations of a single ink's colour and corresponding halo colour, all of which have been computed in step 601.

(ii) Where an element includes both colour and halo for any ink, the element is assigned to be equal to the element which has the halo removed.

(iii) Where an element includes two or more halos, the element is assigned to be equal to the element which has the halos removed.

(iv) Where an element includes three or more main ink colours, the element is assigned to be equal to the element which has all the halos removed.

(v) If a combination of inks will flood when printed, there is no requirement to know the value of the combination accurately. If the combination contains black, it is assinged to be equal to black. Otherwise, it is assigned to be equal to the element which has all thin inks (ie, $C^-$ and $M^-$ inks) removed.

The above rules (i) to (v) are applied in sequence to each element of the Double Neugebauer set K as the multi-ink parameters are calculated in step 603 for each of the X, Y and Z components.

Three specific sample sets of colour patches, refered to herein as "Measurement Sets A, B and C", respectively, are used in the preferred implementation.

(i) Measurement Set A

Measurement set A comprises ink patches of single ink only. Set A is only used in step 601 of FIG. 6 when determining the parameters of single ink blends. For accurate printer characterisation, it is necessary to determine the paper colour plus three parameters for each ink. If a redundancy of 100% is required to ensure reliable determination, at least six sample colour patches for each ink are preferably used. The patches should be visually spread between the colour of paper and fall ink for the particular printer being characterised.

(ii) Measurement Set B

For accurate characterisation, it is important to have measurements that are spread over the whole printer colour gamut to be modelled. However, for most printers, there is no real necessity to accurately model the whole gamut since the whole gamut is not used in the production of images.

Measurement Set B is used to provide information which keeps the multi-ink model stable. When used in the least squares process the values measured from set B are weighted with a very low weight.

Measurement Set B comprises all multiple ink Neugebauer primaries which do not flood. For a six ink printer there are 64 primaries. Depending on the printer, about a third of these will flood and seven are not relevant because they consist of a single or no ink. In this circumstance, Measurement Set B will contain 35 patches. For printers with fewer than 6 inks, the inventor found that a more stable characterisation was achieved when set B was augmented with some mid range samples.

Set B should not contain any patches printed with a single ink as these do not contribute to the second part (i.e step 603) of the multi-ink characterisation. For a three ink printer, Set B is not required since set B will not differ from Set C below.

(iii) Measurement Set C

Measurement Set C preferably comprises double the number of samples as the number of elements that are required for Measurement Set B. Set C should not contain any patches printed with just a single ink as these will not contribute to the second part (ie. step 603) of the multi-ink characterisation. Likewise paper colour is not relevant.

The region of a model gamut most important to accurate printer characterisation is that region which results from the "Black Channel Generation (BG), Under Colour Removal (UCR) and Ink Split methods" to be used. Measurement Set C comprises of colours that are visually evenly spaced throughout this region.

Table 1 below lists typical sample set sizes and number of parameters that will result if the preferred method of characterising a printer is used. Table 1 below lists these values for three different ink systems.

System 1: CMY inks;

System 2: CMYK inks; and

System 3: $C^+C^-M^+M^-YK$ inks.

TABLE 1

| SYSTEM | 1 | 2 | 3 |
|---|---|---|---|
| Typical Set A Size (Number of Samples) | 7 × 3 | 7 × 4 | 7 × 6 |
| Typical Set B Size (Number of Samples) | Redundant for 3 inks. | 64 (Includes mid range samples) | 35 (Non-flooding Neugebauer primaries only) |
| Typical Set C Size (Number of Samples) | 150 (Includes mid range samples) | 200 | 300 |
| Step 601 degrees of freedom. | 10 | 13 | 19 |
| Step 603 degrees of freedom. | 13 | 34 | 125 |

The values in Table 1 in relation to the degrees of freedom for steps 601 and 603, represent the number of Double Neugebauer primaries required to solve the multi-ink model for the specified printer system. As can be observed in Table 1, for the six ink printer case, the number of Double Neugebauer primaries required to solve the multi-ink model is reduced from 4096 to 125. Therefore, computation is greatly reduced using the preferred method of characterising a printer in accordance with the present invention.

Any printer characterisation model is not useful unless the model can be inverted and ink amounts needed to achieve required colours calculated. The Multi-ink model (Equation (1)) cannot be analytically inverted. Therefore, a numerical inversion must be carried out. Further, any printer characterisation is a function of n variables which produces three outputs where n is the number of inks. When n>3, the function cannot be inverted without further constraints. Black Channel Generation (BG), Under Colour Removal (UCR) and Ink Split (IS) methods become those constraints.

Letting C(inks) represent the printer characterisation function, consider the function U(c,m,y) which computes the inks based on some arbitrary cyan, magenta and yellow values. U(c,m,y) will typically involve BG, UCR and IS. The compound function C(U(c,m,y)) can be numerically inverted provided that the function U is chosen appropriately. Few generally reliable methods are available for multi-variate root determination. In the preferred implementation, multi-variate Newton's method was used to solve the equation $$(x,y,z)=C(U(c,m,y)),$$

for values of (x,y,z) that appear in the printer characterisation gamut. Newton's method is iterative and dependent on a first approximation. The inventor found that the choice of the first approximation and the choice of the U(c,m,y) function are important in achieving a reliable inversion.

The inventor also observed that on some printers adding yellow ink to black makes a lighter colour, presumably because there is a stronger reflective component to yellow. Many printers place yellow over black. Therefore, the preferred UCR selected replaced 100% of yellow but only 80% of Cyan and Magenta. The values of the function U are decided for the eight corners of a unit cube.

U(0,0,0)=(0,0,0,0)

U(0,0,1)=(0,0,1,0)

U(0,1,0)=(0,1,0,0)

U(0,1,1)=(0,1,1,0)

U(1,0,0)=(1,0,0,0)

U(1,0,1)=(1,0,1,0)

U(1,1,0)=(1,1,0,0)

U(1,1,1)=(0.2,0.2,0,1)

Tri-linear interpolation on the resulting cube of values is preferably used to compute U(c,m,y). Tri-linear interpolation results in a smooth function and Newton's method requires a function with continuous first partial derivatives in order to be stable.

Given the above, a first approximation of (c,m,y)=(0,0,0), that is paper colour, was found to be a good approximation for about 80% of in-gamut colours. However, the inventor also found that the chosen first approximation was not appropriate for colours close to corners of the unit (c,m,y) cube. To improve the reliability, the intersection (in XYZ colour space) of the vector through the required colour and printer black with the planes (i) to (vi) below is preferably calculated.

| | | | | |
|---|---|---|---|---|
| (i) | C(U(c,m,y)) where (c,m,y) is | (0,0,0) | (1,0,0) | (0,1,0) |
| (ii) | C(U(c,m,y)) where (c,m,y) is | (0,0,0) | (0,1,0) | (0,0,1) |
| (iii) | C(U(c,m,y)) where (c,m,y) is | (0,0,0) | (0,0,1) | (1,0,0) |
| (iv) | C(U(c,m,y)) where (c,m,y) is | (1,1,0) | (1,0,0) | (0,1,0) |
| (v) | C(U(c,m,y)) where (c,m,y) is | (0,1,1) | (0,1,0) | (0,0,1) |
| (vi) | C(U(c,m,y)) where (c,m,y) is | (1,0,1) | (0,0,1) | (1,0,0) |

The computation is preferably carried out in the order (ie. (i) to (vi)) given above and the first computation that determines that the intersection lies within the triangle which defines the plane is preferably used to compute the first approximation. The approximation is preferably determined with weighted averaging of the points such that the weights are the same as those which result in the intersection point computed. The preferred intersection calculation is not possible if the required (X,Y,Z) value is close to printer black. Where no appropriate intersection point can be found in this manner, white is preferably used.

If white does not result in a solution, the components of the first approximation are preferably halved and Newton's method retried. If still no solution is found (c,m,y)=(1,1,1) is used.

The function C(U(c,m,y)) is not computable outside the domain $0 \leqq c,m,y \leqq 1$, as any value outside this domain is outside the domain of observations used in the least squares process. Therefore, when computing Newton's method, the consecutively refined estimates are preferably constrained to the domain $0 \leqq c,m,y \leqq 1$. By using consecutively refined estimates as described, the multi-ink model (i.e.: formula (1)) can therefore be inverted.

The above indicates that a method of determining a first approximation for the iterative computation of amounts of ink which will result in a required colour when printed on a printer can be determnined. Where the required colour can be determined by the use of an analytical printer characterisation function, the method operates in a Cartesian colour coordinate colour space and commences by determining the colour of black on the printer. If the required colour is close to black, the first approximation comprises those inks required to produce black.

If the required colour is not black, then a line is constructed that passses through black and the required colour. Then the intersection of the line and each plane defined by sets of three colours (c1, c2, c3) is determined, in which each set creating a corresponding triangle resulting from the following ink combinations:

| Ink1 | Ink2 | Ink3 |
|---|---|---|
| Paper | Yellow | Cyan |
| Paper | Cyan | Magenta |
| Paper | Magenta | Yellow |
| Yellow + Cyan | Yellow | Cyan |
| Cyan + Magenta | Cyan | Magenta |
| Magenta + Yellow | Magenta | Yellow. |

If the intersection of the line and the plane lies within the triangle then it is necessary to compute a number of weights (w1, w2, w3) which have to satisfy:

$$w1c\mathbf{1}+w2c\mathbf{2}+w3c\mathbf{3}=\text{colour at the intersection},$$

and then compute the first approximation for the amounts of ink as:

$$w1*\text{Ink}\mathbf{1}+w2*\text{Ink}\mathbf{2}+w3\text{Ink}\mathbf{3},$$

otherwise paper colour (no ink) is used at the first approximation.

In view of the above, the aforementioned preferred method of characterising a colour printer provides a relatively easier method of characterising a colour printer using a relatively small number of measured samples compared to prior art methods.

The aforementioned preferred method of characterising a colour printer comprises a particular control flow. There are many other variants of the preferred method which use different control flows without departing from the spirit or scope of the invention. Furthermore one or more of the steps of the preferred method can be performed in parallel rather sequentially.

Figure 7:
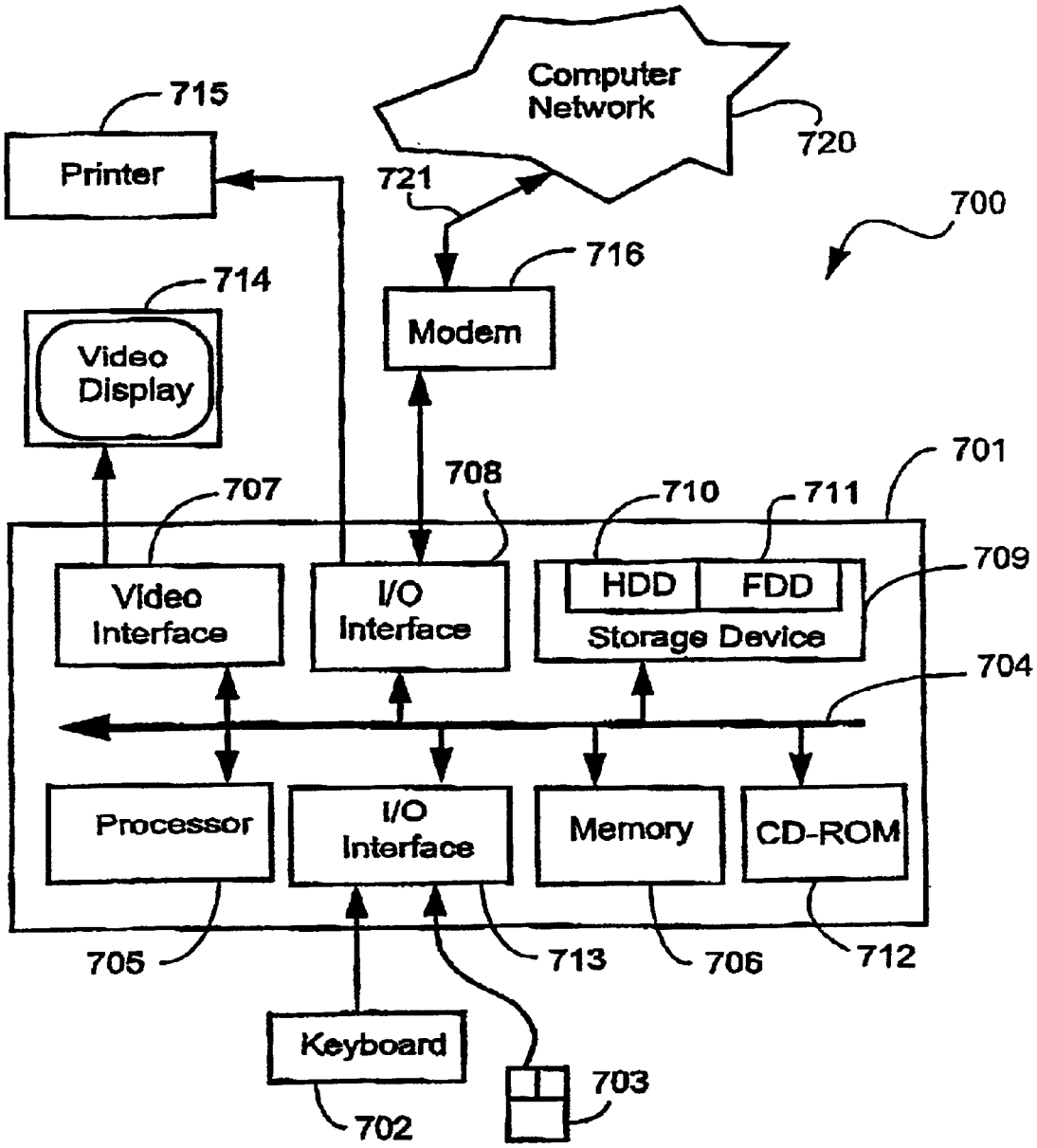
FIG. 7 is a schematic block diagram of a general purpose computer upon which the process described herein can be practiced.

The method of characterising a colour printer is preferably practiced using a conventional general-purpose computer system 700, such as that shown in FIG. 7, wherein step 105 of FIG. 1, and the subsequent calculation of the CIE X, Y and Z components, can be implemented as software, such as an application program executing within the computer system 700. In particular, step 105 is effected by instructions in the software that are carried out by the computer. The software can be divided into two separate parts; one part for carrying out the method of characterising the printer; and another part to manage the user interface between the latter and the user. The software may be stored in a computer readable medium, including the storage devices described below, for example. The software is loaded into the computer from the computer readable medium, and then executed by the computer. A computer readable medium having such software or computer program recorded on it is a computer program product. The use of the computer program product in the computer preferably effects an advantageous apparatus for determining pixel edge orientation for a pixel-based image in accordance with the embodiments of the invention.

The computer system 700 comprises a computer module 701, input devices such as a keyboard 702 and mouse 703, output devices including a printer 715 and a display device 714. A Modulator-Demodulator (Modem) transceiver device 716 is used by the computer module 701 for communicating to and from a communications network 720, for example connectable via a telephone line 721 or other functional medium. The modem 716 can be used to obtain access to the Internet, and other network systems, such as a Local Area Network (LAN) or a Wide Area Network (WAN).

The computer module 701 typically includes at least one processor unit 705, a memory unit 706, for example formed from semiconductor random access memory (RAM) and read only memory (ROM), input/output (I/O) interfaces including a video interface 707, and an I/O interface 713 for the keyboard 702 and mouse 703 and optionally a joystick (not illustrated), and an interface 708 for the modem 716. A storage device 709 is provided and typically includes a hard disk drive 710 and a floppy disk drive 711. A magnetic tape drive (not illustrated) may also be used. A CD-ROM drive 712 is typically provided as a non-volatile source of data. The components 705 to 713 of the computer module 701, typically communicate via an interconnected bus 704 and in a manner which results in a conventional mode of operation of the computer system 700 known to those in the relevant art. Examples of computers on which the embodiments can be practised include IBM-PC's and compatibles, Sun Sparcstations or alike computer systems evolved therefrom.

Typically, the application program of the preferred embodiment is resident on the hard disk drive 710 and read and controlled in its execution by the processor 705. Intermediate storage of the program and any data fetched from the network 720 may be accomplished using the semiconductor memory 706, possibly in concert with the hard disk drive 710. In some instances, the application program may be supplied to the user encoded on a CD-ROM or floppy disk and read via the corresponding drive 712 or 711, or alternatively may be read by the user from the network 720 via the modem device 716. Still further, the software can also be loaded into the computer system 700 from other computer readable medium including magnetic tape, a ROM or integrated circuit, a magneto-optical disk, a radio or infra-red transmission channel between the computer module 701 and another device, a computer readable card such as a PCMCIA card, and the Internet and Intranets including email transmissions and information recorded on websites and the like. The foregoing is merely exemplary of relevant computer readable mediums. Other computer readable mediums may be practiced without departing from the scope and spirit of the invention.

The method of characterisation can alternatively be implemented in dedicated hardware such as one or more integrated circuits performing the functions or sub functions of FIG. 1. Such dedicated hardware can include graphic processors, digital signal processors, or one or more microprocessors and associated memories.

The foregoing describes only some embodiments of the present invention, and modifications and/or changes can be made thereto without departing from the scope and spirit of the invention, the embodiment(s) being illustrative and not restrictive.

What is claimed is:

1. A method of predicting colors resulting from using one ink on a printer, said method comprising the steps of:

producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots;

measuring each of said sample ink patches to produce a plurality of color space coordinates for each said patch; and fitting values representing a number of dots for each said patch and said color space coordinates to a plurality of predetermined functions using a minimization process in order to predict said colors, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents a number of dots for a particular patch, $f_x(a)$, $f_y(a)$ and $f_z(a)$ are functions of a, and wherein $P_x$, $P_y$, and $P_z$ are color space components representing a paper color, and $I_x$, $I_y$, and $I_z$ are color space components representing the ink color.

2. The method according to claim 1, wherein said functions $f_x(a)$, $f_y(a)$ and $f_z(a)$ are of the form:

$$f(a) = \frac{a}{a(1-k)+k}$$

wherein k is a constant which can be different in each of $f_x(a)$, $f_y(a)$ and $f_z(a)$.

3. The method according to claim 1 wherein said functions $f_x(a)$, $f_y(a)$ and $f_z(a)$ are derived from an assumption that each ink dot consists of a first color being a main ink color and a second color being a different color from said main ink color.

4. The method according to claim 3, wherein said functions $f_x(a)$, $f_y(a)$ and $f_z(a)$ are of the form $$f(a) = \frac{a}{a(1-k)+k} + k'a\left(1 - \frac{a}{a(1-k)+k}\right)$$

wherein k and k' are constants which can be different in each of $f_x(a)$, $f_y(a)$ and $f_z(a)$.

5. A method of predicting colors resulting from using one ink on a printer, said method comprising the steps of:

producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots;

measuring each of said sample ink patches to produce a plurality of color space coordinates for each said patch; and fitting values representing a ratio of dots for each said patch and said color space coordinates to a plurality of predetermined functions using a minimization process in order to predict said colors, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents a ratio of dots for a particular patch, $f_x(a)$, $f_y(a)$ and $f_z(a)$ are functions of a, and are derived from a section of the curve y=1/x, and wherein $P_x$, $P_y$ and $P_z$ are color space components representing a paper color, and $I_x$, $I_y$, and $I_z$ are color space components representing the ink color.

6. The method according to claim 1 or 5, wherein said minimization process is a least squares process.

7. A method of determining a first approximation for the iterative computation of amounts of ink which will result in a required color when printed on a printer, utilizing three inks, where said required color can be determined by the use of an analytical printer characterization function, said method operating in a coordinate color space and comprising the steps of:

(a) determining the color of black on the printer;

(b) if the required color is close to black, said first approximation comprises those inks required to produce black;

(c) if the required color is not close to black:

(i) construct a line that passes through black and said required color (ii) construct six planes corresponding to six sets (s1, s2, s3, s4, s5, s6) of ink combinations (Ink1, Ink2, Ink3) as follows, said ink combinations representing sets of three colors (c1, c2, c3) in said coordinate color space:

| | Ink1 | Ink2 | Ink3 |
|---|---|---|---|
| s1 | Paper | Yellow | Cyan |
| s2 | Paper | Cyan | Magenta |
| s3 | Paper | Magenta | Yellow |
| s4 | Yellow + Cyan | Yellow | Cyan |
| s5 | Cyan + Magenta | Cyan | Magenta |
| s6 | Magenta + Yellow | Magenta | Yellow |

(iii) determine an intersection of said line with each of said planes; and (iv) if the intersection of the line with one of said planes lies within a triangle formed from one of said sets of three colors corresponding to ink combinations for said one plane:

then (iv-a) compute weights (w1, w2, w3) which have to satisfy w1c1+w2c2+w3c3=color at the intersection; and (iv-b) compute said first approximation for the amounts of ink as w1*Ink1+w2*Ink2+w3*Ink3;

or else (iv-c) use paper color (no ink).

8. A method of determining a first approximation for the iterative computation of amounts of ink which will result in a required color when printed on a multi-ink printer, where said required color can be determined by the use of an analytical printer characterization function, said method operating in a coordinate color space and comprising the steps of:

(a) determining the color of black on the printer;

(b) if the required color is close to black, said first approximation comprises those inks required to produce black;

(c) if the required color is not close to black:

(i) construct a line that passes through black and said required color, (ii) construct six planes corresponding to six sets (s1, s2, s3, s4, s5, s6) of ink combinations (Comb1, Comb2, Comb3) as follows, said ink combinations representing sets of three colors (c1, c2, c3) in said coordinate color space and being produced according to a function U(c,m,y) as hereinbefore defined;

| | Comb1 | Comb2 | Comb3 |
|---|---|---|---|
| s1 | (0,0,0) | (1,0,0) | (0,1,0) |
| s2 | (0,0,0) | (0,1,0) | (0,0,1) |
| s3 | (0,0,0) | (0,0,1) | (1,0,0) |
| s4 | (1,1,0) | (1,0,0) | (0,1,0) |
| s5 | (0,1,1) | (0,1,0) | (0,0,1) |
| s6 | (1,0,1) | (0,0,1) | (1,0,0) |

(iii) determine an intersection of said line with each of said planes; and (iv) if the intersection of the line with one of said planes lies within a triangle formed from one of said sets of three colors corresponding to ink combinations for said one plane:

then (iv-a) compute weights (w1, w2, w3) required to satisfy w1c1+w2c2+w3c3=color at the intersection; and (iv-b) compute said first approximation for the amounts of ink as w1*Comb1+w2*Comb2+w3*Comb3;

or else (iv-c) use paper color (no ink).

9. A method according to claim 7 or 8, wherein the iterative procedure is a multidimensional Newton's method.

10. A method according to claim 7 or 8, wherein said printer comprises an ink-jet printer.

11. Apparatus for implementing the method of claim 7 or 8.

12. A computer program comprising code for performing the method of claim 7 or 8.

13. A method of predicting colors for a multi-ink ink-jet printer, said method comprising the steps of:

producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots for said corresponding patch;

measuring each of said sample ink patches to produce a plurality of color space coordinates for each said patch; and fitting values representing a ratio of dots for each said patch and said color space coordinates to a predetermined function using a minimization process in order to predict said colors, wherein said predetermined function defines a weighted mean of a Double Neugebauer Set of color elements.

14. The method according to claim 13, wherein said predetermined function is of the form:

$$C = \sum_{p=K} C_p \left[ \prod_{i=0}^{n} I_i \in p ? f(a_i) : 1 - f_i(a_i) \right] \left[ \prod_{i=0}^{n} H_i \in p ? g(a_i) : 1 - g_i(a_i) \right]$$

wherein C represents a resultant component of said color space, and wherein

K is a Double Neugebauer Set of color elements $=\{P_1, \ldots, P_{2^n}\}$;

Cp is the X, Y or Z component of the XYZ color of the primary p;

$I_i \epsilon p$ is true if the $i^{th}$ ink's primary color is included in the Neugebauer primary p;

$H_i \epsilon p$ is true if the $i^{th}$ ink's secondary color is included in the Neugebauer primary p;

$a_i$ represents a ratio of dots for the $i^{th}$ ink; and wherein said expression P?x:y takes the value x if P is true and y otherwise.

15. The method according to claim 14, wherein said Double Neugebauer Set of color elements is reduced by elimination of unnecessary and/or unwanted elements.

16. The method according to claim 15, wherein said reduction is achieved by a reduction method comprising the steps of:

eliminating elements from said Double Neugebauer Set comprising both an ink's primary and secondary colors;

eliminating elements from said Double Neugebauer Set comprising two or more secondary colors of inks without primary colors corresponding to said secondary colors;

eliminating elements from said Double Neugebauer Set comprising at least three primary colors and at least one secondary color; and eliminating elements from said Double Neugebauer Set comprising ink combinations which will result in flooding when printed utilizing said color printer.

17. The method according to claim 14, wherein $$f_i(a_i) = \frac{a_i}{a_i(1-k_i)+k_i}$$

and $k_i$ is a constant derived for said printer.

18. The method according to claim 14, wherein $g(a_i)=k'_i a_i$ and $k'_i$ is a constant derived for said printer.

19. The method according to claim 14, wherein $$f_i(a_i) = \frac{a_i}{a_i(1-k_i)+k_i},$$

$g(a_i)=k'_i a_i$ and $k_i$ and $k'_i$ are constants derived for said printer.

20. The method according to claim 13, wherein each different colored ink of a patch has an associated one of said ratios.

21. An apparatus for predicting colors resulting from using one ink on a printer, said apparatus comprising:

means for producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots for said corresponding patch;

means for measuring each of said sample ink patches to produce a plurality of color space coordinates for each said patch; and means for fitting values representing a number of dots for each said patch and said color space coordinates to a plurality of predetermined functions using a minimization process in order to predict said colors, wherein said predetermined functions are of the form $$P_x(1-f_x(a))+I_x f_x(a);$$
$$P_y(1-f_y(a))+I_y f_y(a);$$
$$P_z(1-f_z(a))+I_z f_z(a);$$

where a represents a number of dots for a particular patch, $f_x(a)$, $f_y(a)$ and $f_x(a)$ are functions of a, and wherein $P_x$, $P_y$ and $P_z$ are color space components representing a paper color, and $I_x$, $I_y$, and $I_z$ are color space components representing the ink color.

22. The apparatus according to claim 21, wherein said functions $f_x(a)$, $f_y(a)$ and $f_z(a)$ are of the form:

$$f(a) = \frac{a}{a(1-k)+k}$$

wherein k is a constant which can be different in each of $f_x(a)$, $f_y(a)$ and $f_z(a)$.

23. The apparatus according to claim 21, wherein said functions $f_x(a)$, $f_y(a)$ and $f_z(a)$ are derived from an assumption that each ink dot consists of a first color being a main ink color and a second color being a different color from said main ink color.

24. The apparatus according to claim 23, wherein said functions $f_x(a)$, $f_y(a)$ and $f_z(a)$ are of the form $$f(a) = \frac{a}{a(1-k)+k} + k'a\left(1 - \frac{a}{a(1-k)+k}\right)$$

wherein k and k' are constants which can be different in each of $f_x(a)$, $f_y(a)$ and $f_z(a)$.

25. An apparatus for predicting color resulting from using one ink on a printer, said apparatus comprising:

means for producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots;

means for measuring each of said sample ink patches to produce a plurality of color space coordinates for each said patch; and means for fitting values representing a ratio of dots for each said patch and said color space coordinates to a plurality of predetermined functions using a minimization process in order to predict said colors, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents a ratio of dots for a particular patch, $f_x(a)$, $f_y(a)$ and $f_z(a)$ are functions of a and are derived from a section of the curve y=1/x, and wherein $P_x$, $P_y$ and $P_z$ are color space components representing a paper color, and $I_x$, $I_y$ and $I_z$ are color space components representing the ink color.

26. Apparatus according to any one of claims 21 to 24, comprising a colorimeter for measuring each of said sample patches and a computer system for producing said test page and for performing said fitting.

27. The apparatus according to any of claims 21 or 25, wherein said minimization process is a least squares process.

28. An apparatus for predicting colors for a multi-ink ink-jet printer, said apparatus comprising:

means for producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots for each corresponding patch;

means for measuring each of said sample ink patches to produce a plurality of color space coordinates for each said patch; and means for fitting values representing a ratio of dots for each said patch and said color space coordinates to a predetermined function using a minimization in order to predict said colors process, wherein said predetermined function defines a weighted mean of a Double Neugebauer Set of color elements.

29. The apparatus according to claim 28, wherein each different colored ink of a patch has an associated one of said ratios.

30. The apparatus according to claim 28, wherein said predetermined functions are of the form:

$$C = \sum_{p \in K} C_p \left[\prod_{i=0}^{n} I_i \in p ? f_i(a_i) : 1 - f_i(a_i)\right] \left[\prod_{i=0}^{n} H_i \in p ? g_i(a_i) : 1 - g_i(a_i)\right]$$

wherein C represents a resultant component of said color space, and wherein

K is a Double Neugebauer Set of color elements $=\{P_i, \ldots, P_2^{2n}\}$;

$C_p$ is the X, Y or Z component of the XYZ color of the primary p;

$I_i \epsilon p$ is true if the $i^{th}$ ink's primary color is included in the Neugebauer primary p;

$H_i \epsilon p$ is true if the $i^{th}$ ink's secondary color is included in the Neugebauer primary p;

$a_i$ represents a ratio of dots for the $i^{th}$ ink; and wherein said expression P?X:y takes the value x if P is true and y otherwise.

31. The apparatus according to claim 30, wherein $$f_i(a_i) = \frac{a_i}{a_i(1-k_i)+k_i}$$

and $k_i$ is a constant derived for said printer.

32. The apparatus according to claim 30, wherein $g(a_i)=k'_ia_i$ and $k'_i$ is a constant derived for said printer.

33. The apparatus according to claim 30, wherein $$f_i(a_i) = \frac{a_i}{a_i(1-k_i)+k_i},$$

$g(a_i)=k'_ia_i$ and $k_i$ and $k'_i$ are constants derived for said printer.

34. The apparatus according to claim 30, wherein said Double Neugebauer Set of color elements is reduced by elimination of unnecessary and/or unwanted elements.

35. The apparatus according to claim 34, wherein said reduction is achieved by a reduction apparatus comprising:

means for eliminating elements of said Double Neugebauer Set comprising both an ink's primary and secondary color;

means for eliminating elements of said Double Neugebauer Set comprising two or more secondary colors of inks without primary colors corresponding to said secondary colors;

means for eliminating elements of said Double Neugebauer Set comprising at least three primary colors and at least one secondary color; and means for eliminating elements of said Double Neugebauer Set comprising ink combinations which will result in flooding when printed utilizing said color printer.

36. A computer program for predicting colors resulting from using one ink on an ink jet printer, said program comprising:

code for measuring each of a plurality of sample ink patches of a test page for said printer to produce a plurality of color space coordinates for each said patch, each said patch comprising a plurality of ink dots according to a predetermined ratio for each patch, said predetermined ratios being based on a number of dots printed for a corresponding patch compared to a maximum number of dots; and code for fitting values representing a number of dots for each said patch and said color space coordinates to a plurality of predetermined functions using a minimization process in order to predict said colors, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents a number of dots for a particular patch, $f_x(a)$, $f_y(a)$ and $f_z(a)$ are functions of a, and wherein $P_x$, $P_y$ and $P_z$ are color space components representing a paper color, and $I_x$, $I_y$ and $I_z$ are color space components representing the ink color.

37. The program according to claim 36, wherein said functions $f_x(a)$, $f_y(a)$ and $f_z(a)$ are of the form $$f(a) = \frac{a}{a(1-k)+k}$$

wherein k is a constant which can be different in each of $f_x(a)$, $f_y(a)$ and $f_z(a)$.

38. The program according to claim 36, wherein said functions $f_x(a)$, $f_y(a)$ and $f_z(a)$ are derived from an assumption that each ink dot consists of a first color being a main ink color and a second color being a different color from said main ink color.

39. The program according to claim 38, wherein said functions $f_x(a)$, $f_y(a)$ and $f_z(a)$ are of the form $$f(a) = \frac{a}{a(1-k)+k} + k'a\left(1 - \frac{a}{a(1-k)+k}\right)$$

wherein k and k' are constants which can be different in each of $f_x(a)$, $f_y(a)$ and $f_z(a)$.

40. A program for predicting colors resulting from using one ink on a printer, said program comprising:

code for measuring each of a plurality of sample ink patches of a test page for said printer to produce a plurality of color space coordinates for each said patch, each said patch comprising a plurality of ink dots according to a predetermined ratio for each patch, said predetermined ratios being based on a number of dots printed for a corresponding patch compared to a maximum number of dots; and code for fitting values representing a ratio of dots for each said patch and said color space coordinates to a plurality of predetermined functions using a minimization process in order to predict said colors, wherein said predetermined functions are of the form $$P_x(1-f_x(a))+I_xf_x(a);$$

$$P_y(1-f_y(a))+I_yf_y(a);$$

$$P_z(1-f_z(a))+I_zf_z(a);$$

where a represents a ratio of dots for a particular patch, $f_x(a)$, $f_y(a)$ and $f_z(a)$ are functions of a and are derived from a section of the curve y=1/x, and wherein $P_x$, $P_y$ and $P_z$ are color space components representing a paper color, and $I_x$, $I_y$ and $I_z$ are color space components representing the ink color.

41. The program according to any one of claims 36 or 40, wherein said minimization process is a least squares process.

42. A computer program for predicting colors for a multi-ink ink-jet printer, said apparatus comprising:

code for producing a test page for said printer, said test page comprising a plurality of sample ink patches, each said patch comprising a plurality of ink dots according to a predetermined ratio for each patch, said predetermined ratios being based on a number of dots printed for a corresponding patch compared to a maximum number of dots;

code for measuring each of said sample ink patches to produce a plurality of color space coordinates for each said patch; and code for fitting values representing a ratio of dots for each said patch and said color space coordinates to a predetermined function using a minimization process in order to predict said colors, wherein said predetermined function defines a weighted mean of a Double Neugebauer Set of color elements.

43. The program according to claim 42, wherein each different colored ink of a patch has an associated one of said ratios.

44. The program according to claim 42, wherein said predetermined function is of the form $$C = \sum_{p \in K} C_p \left[\prod_{i=0}^{n} I_i \in p\,?\,f_i(a_i) : 1 - f_i(a_i)\right] \left[\prod_{i=0}^{n} H_i \in p\,?\,g_i(a_i) : 1 - g_i(a_i)\right]$$

wherein C represents a resultant component of said color space, and wherein

K is a Double Neugebauer Set of color elements $=\{P_i, \ldots, P_n\}$;

$C_p$ is the X, Y or Z component of the XYZ color of the primary p;

$I_i \epsilon p$ is true if the $i^{th}$ ink's primary color is included in the Neugebauer primary p;

$H_i \epsilon p$ is true if the $i^{th}$ ink's secondary color is included in the Neugebauer primary p;

$a_i$ represents a ratio of dots for the $i^{th}$ ink; and wherein said expression P?X:y takes the value x if P is true and y otherwise.

45. The program according to claim 44, wherein $$f_i(a_i) = \frac{a_i}{a_i(1-k_i)+k_i}$$

and $k_i$ is a constant derived for said printer.

46. The program according to claim 44, wherein $g(a_i)=k'_i a_i$ and $k_i$ is a constant derived for said printer.

47. The program according to claim 44, wherein $$f_i(a_i) = \frac{a_i}{a_i(1-k_i)+k_i},$$

$g(a_i)=k'_i a_i$ and $k_i$ and $k'_i$ are constants derived for said printer.

48. The program according to claim 44, wherein said Double Neugebauer Set of color elements is reduced by elimination of unnecessary and/or unwanted elements.

49. The program according to claim 48, wherein said reduction is achieved by:

code for eliminating elements of said Double Neugebauer Set comprising both an ink's primary and secondary colors;

code for eliminating elements of said Double Neugebauer Set comprising two or more secondary colors of inks without primary colors corresponding to said secondary colors;

code for eliminating elements of said Double Neugebauer Set comprising at least three primary colors and at least one secondary color; and code for eliminating elements of said Double Neugebauer Set comprising ink combinations which will result in flooding when printed utilizing said color printer.

* * * * *

UNITED STATES PATENT AND TRADEMARK OFFICE

CERTIFICATE OF CORRECTION

PATENT NO. : 6,848,768 B2
APPLICATION NO. : 10/112937
DATED : February 1, 2005
INVENTOR(S) : Peter Malcolm Roberts It is certified that error appears in the above-identified patent and that said Letters Patent is hereby corrected as shown below:

ON THE COVER PAGE

Item (56), after U.S. Patent Documents insert:

--OTHER PUBLICATIONS

Raja Balasubramanian, "Optimization of the Spectral Neugebauer Model for Printer Characterization," Journal of Electronic Imaging, Vol. 8, No. 2, (April 1999) pp. 156-166.--

COLUMN 10

Line 53, "$1-g_i(a_i)]$" should read -- $l-g(a_i)]$--

COLUMN 15

Line 32, "rather" should read --rather than--.

COLUMN 17

Line 22, "claim 1" should read --claim 1,--.

COLUMN 21

Line 55, "21 to 24," should read --21 to 25,--.

UNITED STATES PATENT AND TRADEMARK OFFICE

CERTIFICATE OF CORRECTION

PATENT NO. : 6,848,768 B2
APPLICATION NO. : 10/112937
DATED : February 1, 2005
INVENTOR(S) : Peter Malcolm Roberts It is certified that error appears in the above-identified patent and that said Letters Patent is hereby corrected as shown below:

Column 22

Line 21, "c = $\sum_{p \in K} C_p \left[ \prod_{i=0}^{n} I_i \in p ? f_i(a_i) : 1 - f_i(a_i) \right]$ $\left[ \prod_{i=0}^{n} H_i \in p ? g_i(a_i) : 1 - g_i(a_i) \right]$" should read --C= $\sum_{p=K} C_p \left[ \prod_{i=0}^{n} I_i \in p ? f(a_i) : 1 - f_i(a_i) \right] \left[ \prod_{i=0}^{n} H_i \in p ? g(a_i) : 1 - g_i(a_i) \right]$ --.

Line 60, "color;" should read --colors;--.

UNITED STATES PATENT AND TRADEMARK OFFICE

CERTIFICATE OF CORRECTION

PATENT NO. : 6,848,768 B2
APPLICATION NO. : 10/112937
DATED : February 1, 2005
INVENTOR(S) : Peter Malcolm Roberts It is certified that error appears in the above-identified patent and that said Letters Patent is hereby corrected as shown below:

COLUMN 24

Lines 46-50, "c = $\sum_{p \in K} C_p \left[ \prod_{i=0}^{n} I_i \in p ? f_i(a_i) : 1 - f_i(a_i) \right]$ $\left[ \prod_{i=0}^{n} H_i \in p ? g_i(a_i) : 1 - g_i(a_i) \right]$" should read --C= $\sum_{p=K} C_p \left[ \prod_{i=0}^{n} I_i \in p ? f(a_i) : 1 - f_i(a_i) \right] \left[ \prod_{i=0}^{n} H_i \in p ? g_i(a_i) : 1 - gi(a_i) \right]$ --.

Line 56, "$P_n$ };" should read -- $P_2^{2n}$ } ;--.

Signed and Sealed this

Twelfth Day of December, 2006

JON W. DUDAS
*Director of the United States Patent and Trademark Office*